United States Patent [19]

Hanneken

[11] Patent Number: 4,682,761

[45] Date of Patent: Jul. 28, 1987

[54] CORNER AND IN-LINE FENCE POST STRESS AND BRACING SYSTEM

[76] Inventor: Robert L. Hanneken, Box 110, Rte. 1, Verona, Mo. 65769

[21] Appl. No.: 772,523

[22] Filed: Sep. 4, 1985

[51] Int. Cl.[4] ..... E04H 17/02

[52] U.S. Cl. ..... 256/36; 256/64; 256/72

[58] Field of Search ..... 256/36, 35, 64, 65, 256/63, 72, 59; 403/362

[56] References Cited

U.S. PATENT DOCUMENTS

| | | | |
|---|---|---|---|
| 310,555 | 1/1885 | Brevoort | 256/63 |
| 725,770 | 4/1903 | Probasco | 256/36 |
| 808,969 | 1/1906 | Boyce | 256/59 |
| 2,445,545 | 7/1948 | Verner | 256/35 |
| 2,840,400 | 6/1958 | D'Azzo | 403/362 |
| 2,879,561 | 3/1959 | Rieder | 403/329 |
| 3,021,116 | 2/1962 | Querengesser | 256/72 |
| 3,334,867 | 8/1967 | Wenaas | 256/35 |
| 3,648,982 | 3/1972 | Sabel et al. | 256/65 |

*Primary Examiner*—Cornelius J. Husar
*Assistant Examiner*—Peter M. Cuomo
*Attorney, Agent, or Firm*—Clarence A. O'Brien; Harvey B. Jacobson

[57] ABSTRACT

A pair of spaced apart, upright and adjacent fence posts are provided having upper and lower end portions and their lower end portions embedded in the ground. An upper horizontal brace extends between and is anchored to the upper end portions of the posts at an elevation spaced appreciably above the ground and a pair of guides are anchored relative to the posts at generally ground level. A pair of elongated inclined braces have their lower ends slidingly engaged with the guides and their upper ends anchored to the longitudinal mid-portion of the horizontal brace. The guides and the lower ends of the inclined braces include co-acting structure releasably locking the lower ends of the inclined braces in adjusted shifted positions relative to the guides.

9 Claims, 5 Drawing Figures

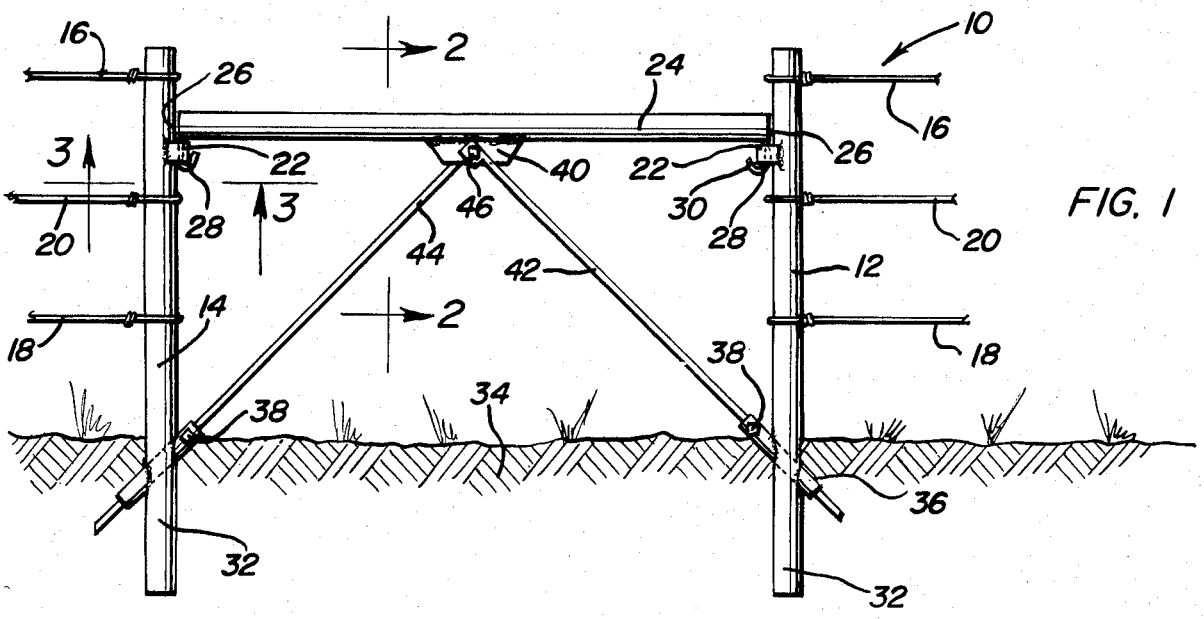
FIG. 1
FIG. 2
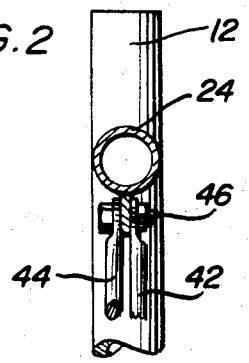
FIG. 3
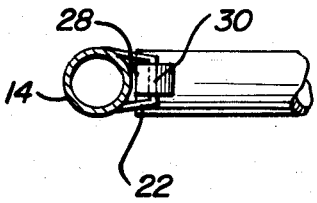
FIG. 4
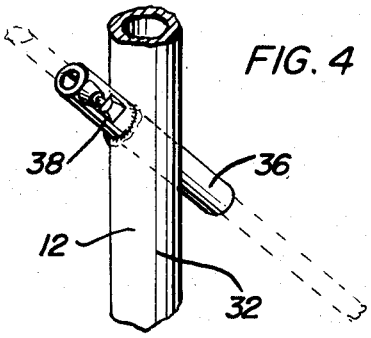
FIG. 5
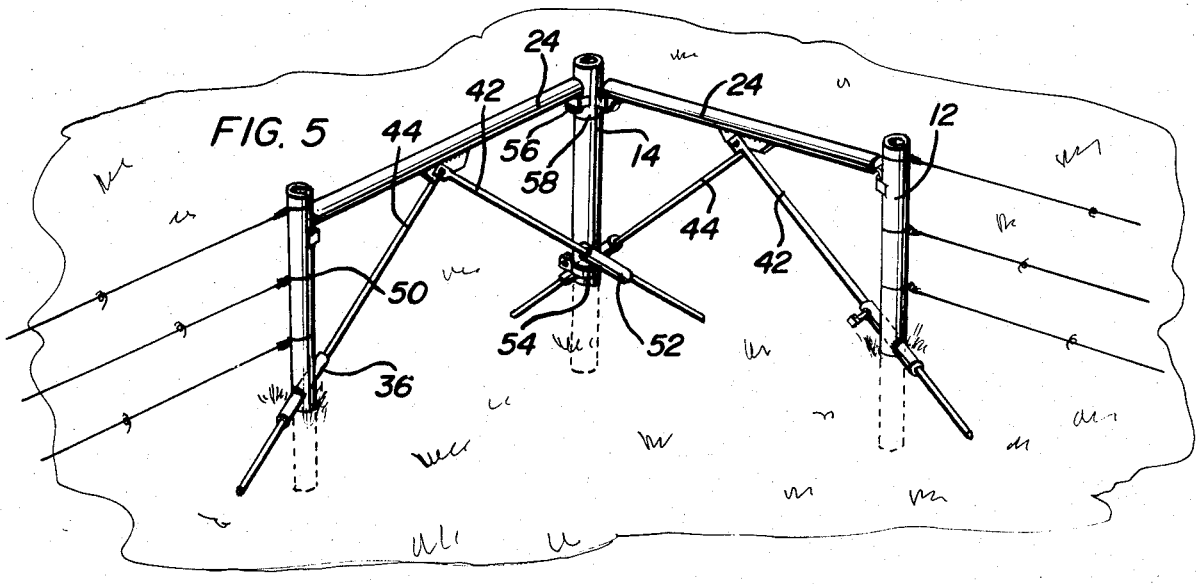

CORNER AND IN-LINE FENCE POST STRESS AND BRACING SYSTEM

BACKGROUND OF THE INVENTION

1. Field of the Invention

The instant invention incorporates at least one pair of adjacent fence posts whose upper ends are rigidly braced by a horizontal rigid brace extending and secured therebetween and whose lower ends are braced relative to the longitudinal mid-portion of the horizontal brace by oppositely upwardly inclined and convergent rigid bracing members anchored at their upper ends to the horizontal brace member and releasably anchored at their lower ends to inclined guides supported from the post lower ends and relative to which the lower ends of the inclined braces are longitudinally slidable, the anchoring of the lower ends of the inclined braces to the guides being effected to releasably lock the braces in longitudinally shifted positions relative to the corresponding post supported guides. More than one pair of adjacent posts may be used in a straight fence run and two pairs of adjacent posts may be used in a corner defined by relatively angulated fence runs.

2. Description of Related Art

Various different forms of fence post bracing systems heretofore have been provided such as those disclosed in U.S. Pat. Nos. 436,279, 451,461, 540,161, 615,855, 725,770, 865,858, and 2,445,545.

Of the above noted patents, U.S. Pat. No. 2,445,545 probably is the most pertinent to the instant invention in that it discloses cross bracing, but any form of cross bracing utilizes excessively long bracing members requiring an additional expense in materials and fully cross braced posts actually can cause excessive stress on one another due to "heaving" of the ground as a result of alternating freezing and thawing of the ground about the base of the cross braced posts.

SUMMARY OF THE INVENTION

The instant invention, in its simple form, incorporates a pair of fence posts having their lower ends embedded in the ground and interconnected adjacent their upper ends by a rigid horizontal brace extending therebetween and secured to the post upper ends. In addition, the longitudinal mid-portion of the horizontal brace is braced relative to the ground level areas of the posts by upwardly convergent inclined braces anchored at their upper ends to the longitudinal mid-portion of the horizontal brace and anchored at their lower ends to the corresponding fence posts.

The main object of this invention is to provide a fence line stress bracing system between adjacent fence line posts and which will be effective to withstand considerable fence line stresses.

Another object of this invention is to provide a fence post bracing system whereby adjacent fence posts disposed intermediate the opposite ends of the fence line or three fence posts defining an intersection between relatively angulated fence lines may be braced relative to each other in order to provide a more stress resistent fence assembly.

Still another important object of this invention is to provide a fence post bracing system which may be effectively utilized during the construction of a fence to establish heavily reinforced fence line areas.

Another object of this invention is to provide a fence post bracing system which will be effective to perform the desired bracing operation even though one or both posts of adjacent posts are subject to "ground heaving".

A final object of this invention to be specifically enumerated herein is to provide a fence post stress and bracing system in accordance with the preceding objects and which will conform to conventional forms of manufacture, be of simple construction and easy to use so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWING

FIG. 1 is a fragmentary elevational view of a mid-length portion of a fence line with the bracing system of the instant invention incorporated therein and being utilized to brace a pair of adjacent posts in the fence line;

FIG. 2 is a fragmentary enlarged vertical sectional view taken substantially upon the plane indicated by the section line 2—2 of FIG. 1;

FIG. 3 is an enlarged fragmentary horizontal sectional view taken substantially upon the plane indicated by the section line 3—3 of FIG. 1;

FIG. 4 is a fragmentary enlarged perspective view of the lower end portion of one of the two adjacent fence posts illustrating the manner in which the tubular guide for anchoring the associated inclined brace is secured through the fence post; and FIG. 5 is a fragmentary perspective view of the corner portion of a fence incorporating the bracing system of the instant invention wherein angulated and intersecting fence runs define a fence corner portion.

DESCRIPTION OF THE PREFERRED EMBODIMENTS

Referring now more specifically to the drawings the numeral 10 generally designates a typical form of wire fence construction utilizing a pair of adjacent upstanding fence posts 12 and 14. Although the fence posts 12 and 14 are illustrated as tubular pipe members, they may actually comprise solid fence posts constructed of other materials such as wood.

Three upper, lower and intermediate sections 16, 18 and 20 of wire extend in opposite directions from the posts 12 and 14 to and past adjacent posts in order to define a substantially straight fence run. In actual practice, the wire sections 16, 18 and 20 may also span the spacing between the posts 12 and 14.

The upper end portion of each of the posts 12 and 14 includes a generally U-shaped clip or bracket 22 secured thereto in any convenient manner such as by welding. In addition, an upper horizontal brace member 24 extends between the upper end portions of the posts 12 and 14 with the opposite ends of the brace member 24 abutted against adjacent sides of the posts 12 and 14. In addition, each end of the brace member 24 includes an end plate 26 secured thereover incorporating a downwardly directed and bendable tine 28. Each of the tines 28 is downwardly received through the corresponding clip or bracket 22 and thereafter has its lower end reversely bent as at 30 in order to releasably anchor each end of the brace member 24 to the corresponding fence post clip or bracket 22.

The fence posts 12 and 14 have their lower end portions 32 embedded in the ground 34 and each lower end portion 32 has a tubular guide 36 secured therethrough at an angle of generally 45 degrees relative to the corresponding post. The guides 36 are upwardly convergent and lie in the same vertical plane in which the fence posts 14 are disposed. Further, the tubular guides 36 are secured through the posts 12 and 14 at substantially ground level with the upper end portions of the guides 36 projecting slightly above ground level and including radial setscrews 38.

The underside of the longitudinal mid-portion of the horizontal brace member 24 includes a vertical bracing and mounting flange 40 secured thereto in any convenient manner such as by welding and a pair of inclined brace members 42 and 44 have their upper ends secured to opposite sides of the flange 40 by a through bolt 46. The lower ends of the brace members 42 are longitudinally slidably received through the tubular guides 36 and are fixedly anchored in adjusted positions projecting through the guides 36 and into the ground 34.

The fence bracing system comprising the posts 12, 14, the upper horizontal brace member 24 and the inclined brace members 42 is operative to withstand excessive fence line stress as well as "heaving" of the ground areas in which the lower ends 32 of the posts 12 and 14 are embedded. Furthermore, the bracing system functions in generally the same manner as cross bracing such as that disclosed in U.S. Pat. No. 2,445,545, but through the utilization of shorter inclined bracing members at a considerable savings of fence materials and the attendant costs thereof. In addition, the bracing system utilizes readily available components which are inexpensive to produce. Still further, initial installation of the posts 12 and 14 may be accomplished with the horizontal brace member 24 in position and without requiring that the posts 12 and 14 be absolutely parallel. Therefore, the spacing between the lower ends of the posts is not critical to the subsequent installation of the inclined brace members 42 and 44, inasmuch as adjustment between the brace members 42 and 44 at the lower ends 32 of the posts 12 and 14 is readily accomplished by the setscrews 38.

If the fence posts 12 and 14 are to be constructed of wood and of solid construction, the tubular guides 36 may be snugly received in inclined bores formed in such wooden posts. Further, the tubular guides themselves may be anchored relative to such wooden posts by through bolts passing through the posts and the tubular guides. In such instance, the lower ends of the inclined brace members 42 will occupy the interiors of only the upper end portions of the tubular guides 36. Further, it will be noted that once the posts 12 and 14 are embedded in the ground it is merely necessary to bend the tabs 28, install the lower ends of the inclined brace members 42 and 44 within the tubular guides 36, install the bolt 46 and then tighten the setscrews 38. These operations can be carried out in a very short period of time of one minute or less.

Referring now more specifically to FIG. 5 of the drawings, it may be seen that the posts 12 and 14 may be utilized in conjunction with a companion post 50 of the same construction to define a fence corner at the intersection of two straight fence runs. The fence posts 12 and 14 are braced relative to each other in the same manner illustrated in FIG. 1 and the fence post 50 is braced relative to the fence post 14 also by an upper horizontal brace member 24 and a pair of inclined brace members 42 and 44. The post 50, being identical to the posts 12 and 14 includes a tubular guide 36 secured therethrough and a supplemental tubular guide 52 is mounted on the lower end of the post 14 in FIG. 5 by a clamp 54. Further, a bracket or clip 56 corresponding to the clips 22 is mounted on the upper end portion of the post 14 in FIG. 5 by a clamp 58, the clamp 56 supporting the right hand end of the upper horizontal brace member 24 extending between the post 50 and the post 14 in FIG. 5 from the post 14. Further, the supplemental tubular guide 52 anchors the lower end of the brace 42 to the post 14 in FIG. 4. Thus, it may be seen that the bracing structure may be used both intermediate the opposite ends of a straight fence run or at the corner of a fence defined between intersecting and relatively angled straight fence runs.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A fence construction comprising a pair of spaced apart, upright fence posts having upper and lower end portions, an outer surface and their lower end portions embedded in the ground, an upper horizontal brace extending between and anchored to the upper end portions of said posts at an elevation spaced appreciably above the ground, a pair of guide members mounted to said posts at generally ground level, a pair of elongated, longitudinally straight and oppositely inclined braces extending between a longitudinal mid-portion of said horizontal brace and said guides with the lower ends of said inclined braces guidingly engaged with said guide members for longitudinal shifting thereto and projecting downwardly and outwardly from said outer surface and into the ground and the upper ends of said inclined braces anchored to the longitudinal mid-portion of said horizontal brace, said guide members and the lower ends of said inclined braces including locking means releasably securing said lower ends of said inclined braces in a relative position with said guide members.

2. The fence construction of claim 1 wherein said guide members include elongated upwardly convergent guide tubes through which the lower ends of said inclined braces are slidingly received.

3. The fence construction of claim 2 wherein said locking means include setscrews threadedly engaged with said guide tubes and releasably engaged with the lower ends of said inclined braces.

4. The fence construction of claim 1 wherein the longitudinal mid-portion of said horizontal brace includes a depending horizontally elongated reinforcing flange secured thereto and extending longitudinally therealong, the upper ends of said inclined braces being anchored relative to said flange.

5. The fence construction of claim 1 wherein said guide members include elongated upwardly convergent guide tubes through which the lower ends of said inclined braces are slidingly received, said guide tubes being secured through said posts.

6. The fence construction of claim 1 including abutment means carried by the outer surface of said fence posts against which the opposite ends of said horizontal upper brace member rest, said abutment means defining upstanding passages extending therethrough, the opposite ends of said upper horizontal brace member including depending tangs downwardly received through said passages and including lower end portions preventing upward retraction of said tangs through said passages.

7. The fence construction of claim 6 wherein the longitudinal mid-portion of said horizontal brace includes a depending horizontally elongated reinforcing flange secured thereto and extending longitudinally therealong, the upper ends of said inclined braces being anchored relative to said flange.

8. The fence construction of claim 7 wherein said guide members include elongated upwardly convergent guide tubes through which the lower ends of said inclined braces are slidingly received, said guide tubes being secured through said posts.

9. The fence construction of claim 1 including a third upright fence post having upper and lower end portions, said third fence post being laterally spaced from one post of said pair of fence posts and having its lower end embedded in the ground, a second upper horizontal brace extending between and anchored to the upper end portions of said third and one posts at an elevation spaced appreciably above the ground, a second pair of guides members mounted to said one and third posts at generally ground level, a second pair of elongated, longitudinally straight and oppositely inclined braces extending between a longitudinal mid-portion of said second horizontal brace and said second pair of guide members with the lower ends slidingly engaged with said second pair of guide members and projecting downwardly and outwardly from said outer surface of said one and third posts and down into the ground and the upper ends of said second pair of inclined braces anchored to the longitudinal mid-portion of said second horizontal brace, said second pair of guide members and the lower ends of said second pair of inclined braces including locking means releasably securing said lower ends of said second inclined braces in a relative position with said second pair of guide members.

* * * * *